US005846115A

United States Patent [19]

Feng

[11] Patent Number: 5,846,115

[45] Date of Patent: Dec. 8, 1998

[54] ANIMATED STUFFED TOY

[76] Inventor: Pan-Chang Pao Feng, 5F-1 No. 81, Sec. 2, Chang-An E. Rd., Taipei, Taiwan

[21] Appl. No.: 577,599

[22] Filed: Dec. 22, 1995

[51] Int. Cl.[6] ..... A63H 13/00

[52] U.S. Cl. ..... 446/175; 446/354

[58] Field of Search ..... 446/175, 300, 446/301, 354, 352, 353, 336, 298

[56] References Cited

U.S. PATENT DOCUMENTS 326,997 9/1885 Littleton et al. ..... 446/353 X 3,851,418 12/1974 Barlow et al. ..... 446/338

4,867,730 9/1989 Lee ..... 446/353

5,356,326 10/1994 Ting ..... 446/175

*Primary Examiner*—Mickey Yu

*Attorney, Agent, or Firm*—Pro-Techtor International

[57] ABSTRACT

An animated stuffed toy whose automatic movements resemble sleepiness or drowsiness. A power source is activated by voice or touch. The power source drives a motor to effect the motion of the toy and to emit sounds, including music, from a speaker. When the music is finished, the power source is deactivated.

5 Claims, 5 Drawing Sheets

ANIMATED STUFFED TOY

BACKGROUND OF THE INVENTION

According to the inventor's experience in developing and designing stuffed toys over the years, the inventor discovered that not much hardwork and research have been put forth on stuffed toys by most people of the world, including the developed countries. The majority of the stuffed toys are only of dull designs or some simple modifications to the limbs of the toys. Until now, there has not been any similarly lively, or even more interesting products.

Perhaps due to cost consideration or complete lack of seriously consideration for special ideas to develop variety of changes in stuffed toys, therefore, kids and older adults alike are progressively losing confidence in this product. They have turned to more visually exciting TV video games, which have little benefit to the body and mind, or video arcades, which are expensive and are frequented by the unsavory elements of the society.

OBJECTIVE OF THE INVENTION

The inventor believes that if stuffed toys do not meet the needs of consumers or to increase its entertainment value, these toys will become obsolete, and therefore the inventor created the "animated stuffed toy." It is hoped that the toys would increase their value and become more entertaining by designing different stuffed animals that move in a drowsiness manner once hearing music such as the "lullaby", as if they were alive. At the same time, the consumers' desires to own the toys can be stimulated by simply making minor changes to the outer appearance of the stuffed toys. The adults would be glad to let their children use the stuffed toys, with the lullaby music and nodding off movements, to induce them to fall asleep. Not only does this invention have increased effects, but also have practical value, which is the main objective of the present invention.

The four figures of FIG. 5 represent the sequential movements of the cam guiding the linkage.

Figure 6:
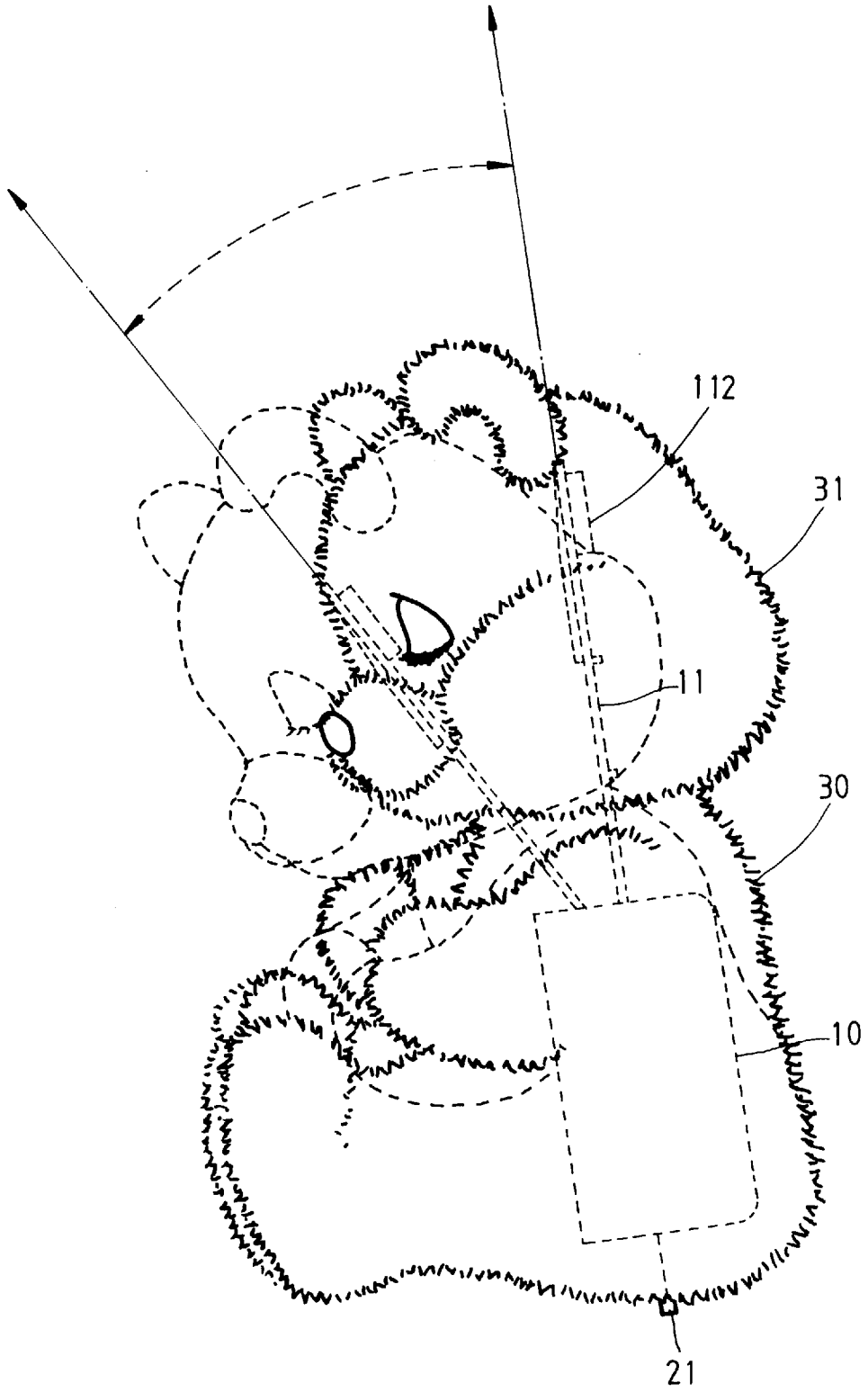

FIG. 6 is an example of implementation.

Figure 1:
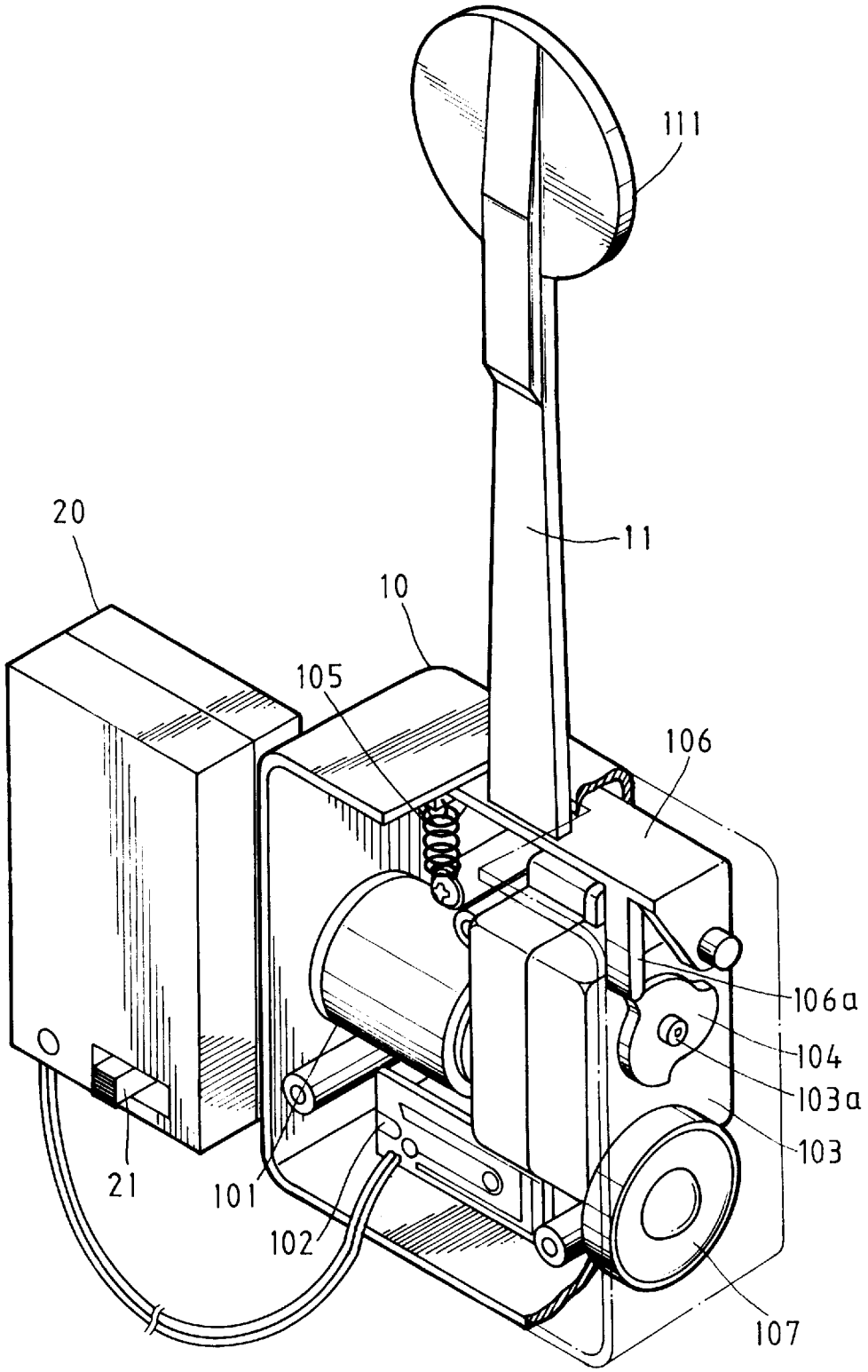
FIG. 1 is a three-dimensional view of the interior drive mechanism of the subject stuffed toy.
Figure 2:
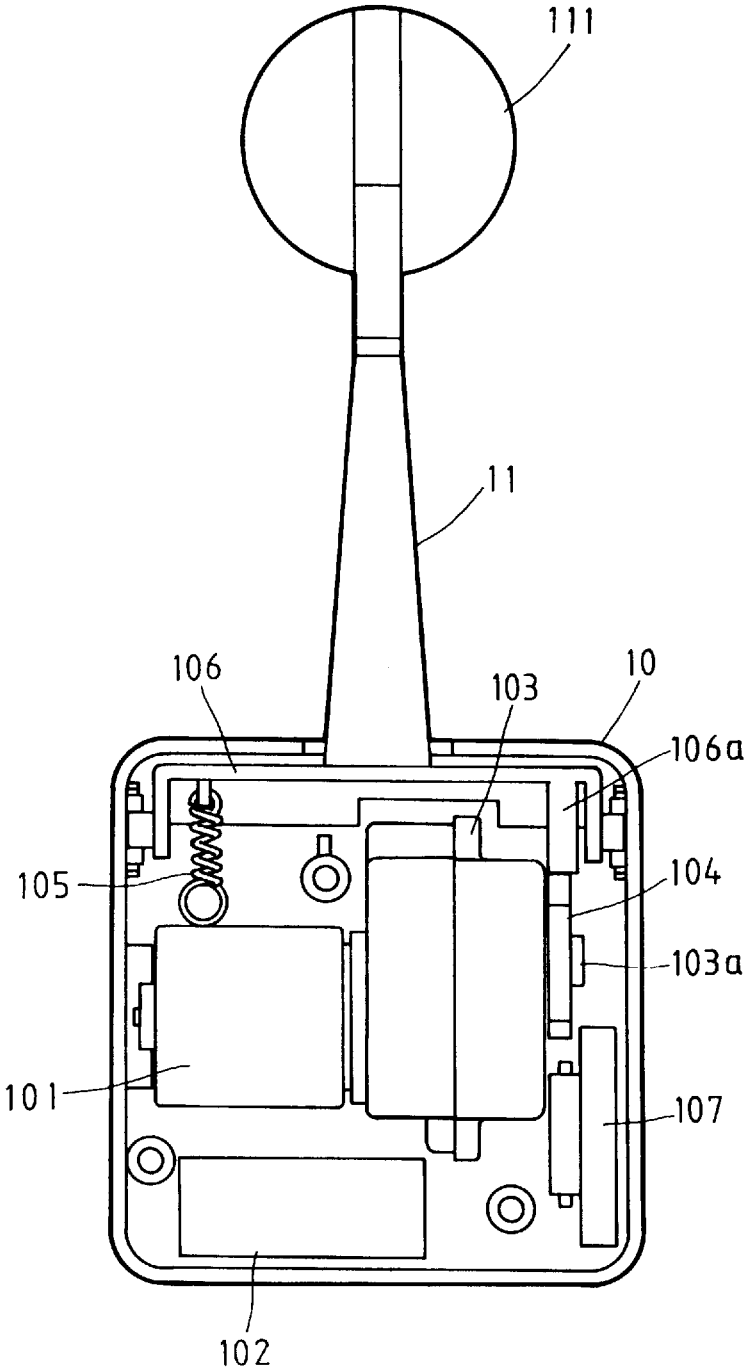
FIG. 2 is a two-dimensional view of the interior drive mechanism the subject stuff toy.
Figure 3:
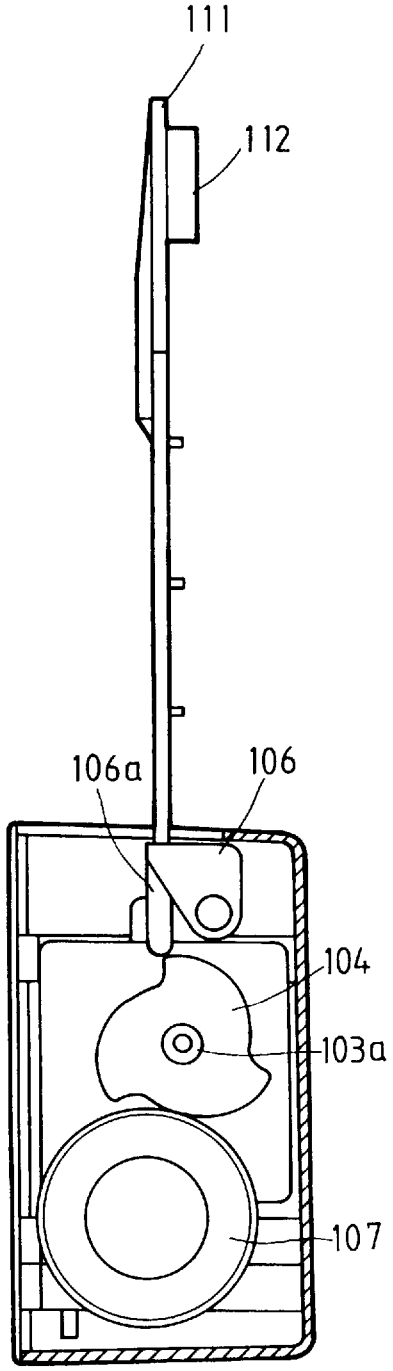
FIG. 3 represents the right side view of FIG. 1.

First, it is not difficult to judge from FIGS. 1, 2 and 3 that the present invention utilizes the driving mechanism to produce the life-like drowsiness movements and broadcast "lullaby" music. (Please also refer to FIG. 6). It is also clear from these figures that the driving mechanism is essentially comprised of a box 10 and a linkage 11 which extends upwards. The box 10 is positioned at the abdominal region 30 of the stuff toy. The linkage 11 extending upwards to the cranial region 31 of the stuff toy. The box 10 comprises a driving motor 101, control circuit 102, gear box 103 and output shaft 103*a* to control speed, a spring 105, a cam 104, a speaker 107, a battery seat 20, electric source switch 21 and a supporting rod 106 which extends downwards from the linkage 11 to the box 10; the driving motor 101 is connected to gear box 103 and by using the gears and pinions inside the gear box 103 to adjust and control the rotating speed of the output shaft 103*a*, which controls the rotating speed of the cam 104. The two sides of the supporting cross rod 106 are situated loosely at the two sides of the box 10,50 as to move in conjunction with the rotation. Further, at the position below where the cross rod 106 is closest to the cam 104 is set a guide rod 106*a*. At the other end, a spring 105 is connected to the cross rod 106 and box 10; by the movement of the cam 104, the guide rod 106*a* is also moved and also bringing into motion the cross rod 106 and the linkage, which extends upwards. At the tip of the linkage 11 there situated a disc 111. On the side of the disc 111 there is installed a sensor 112 (could either be controlled by sound or by touching).

Figure 4:
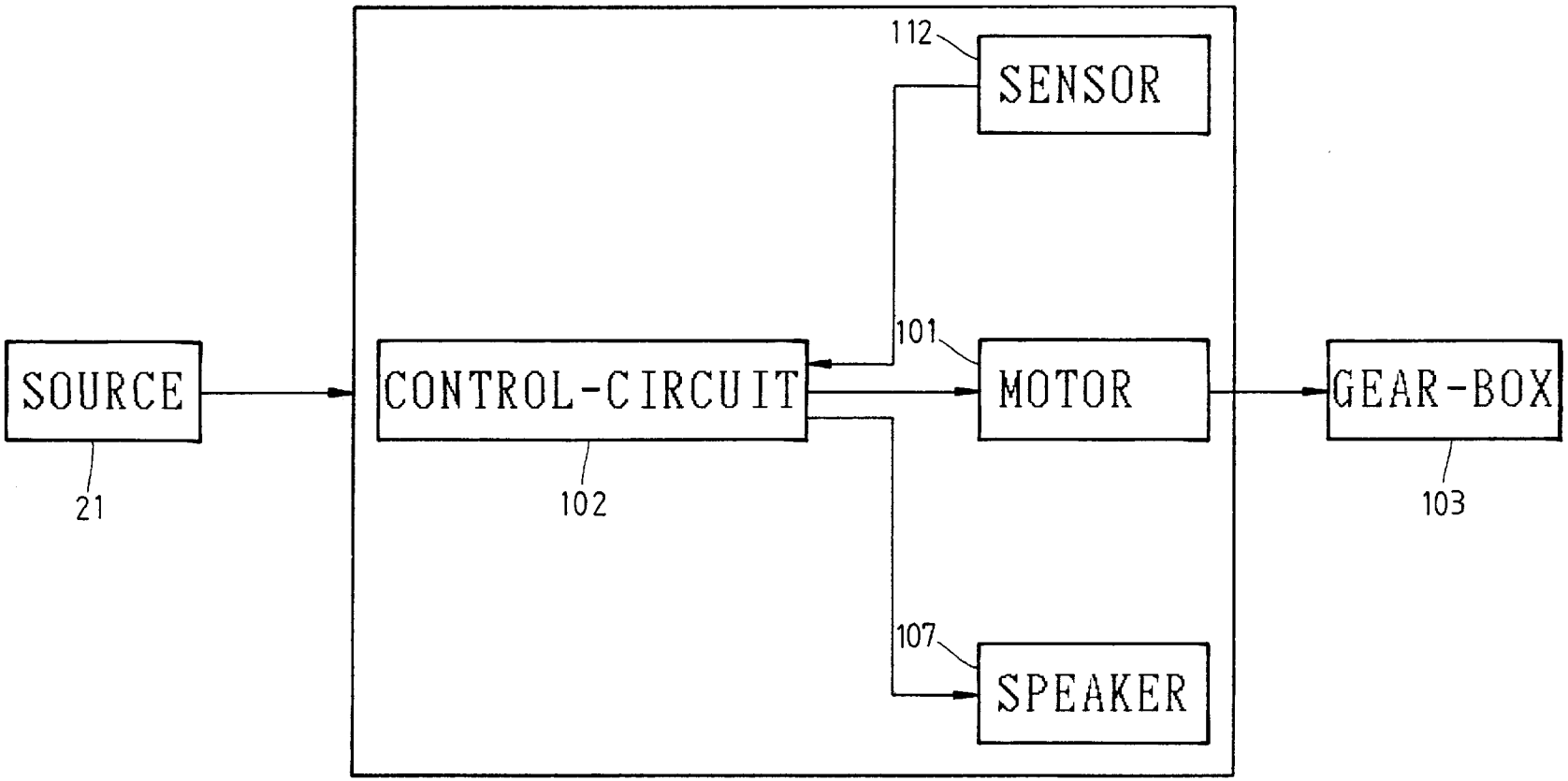
FIG. 4 is a flow chart for the movements of the present invention.

The present invention's movements can be understood by referring to FIG. 4. When the power source switch 21 is turned on (ON), by using the sensor 112 located on the linkage 11 to receive outside noise (or touching) pulse signals are transmitted to the control circuit 102 on the circuit board. After reading and verification by the software in the chip, pulses that drive the motor and sound signals are transmitted, and they are further amplified to push the motor 101 and drive the speaker 107 (which usually preset to play lullaby). After the motor 101 has been driven, the gear box 103 is utilized simultaneously to adjust the speed to drive the cam 104 and the guide rod 106*a*. The supporting cross rod 106 is brought into motion, thereby moving the linkage 11 until the music stops. At which time, the motor also stops, and waits for the next outside signal.

Figures 5A, 5B, 5C, 5D:
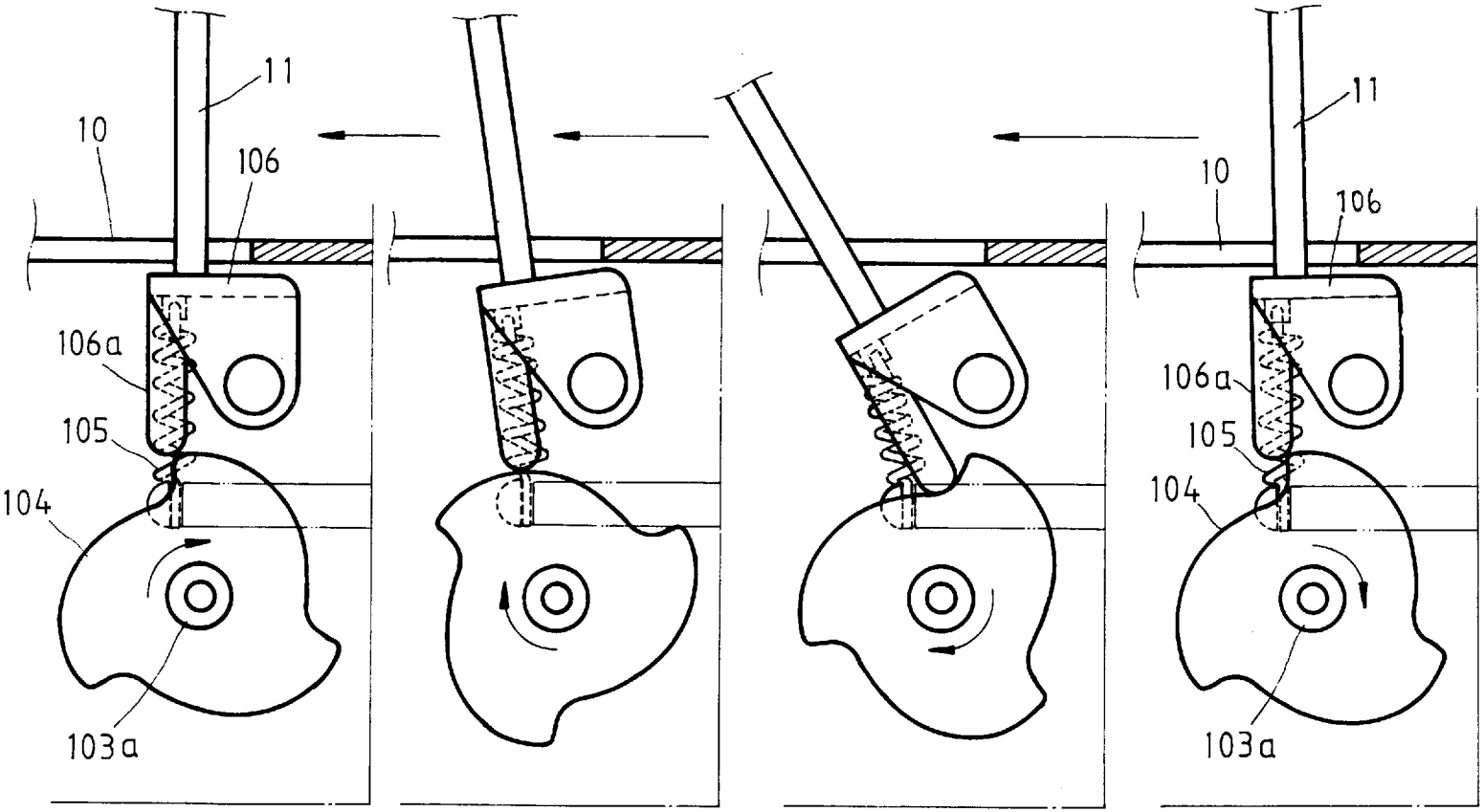

Regarding the movements resembling sleepiness of the stuffed toy, please refer to FIG. 5. It is shown in the Figure that the shape of the cam 104 of the present invention is three sections of discontinuous curves. After the speed of the motor 101 is adjusted through the gear box 103, the cam 104 is also driven (clockwise in the Figure) and at the same time bring the guide rod 106*a*, located below the supporting cross rod 106, into motion. First please refer to FIG. 5*a*, which is the beginning position, the cam is still supporting the guide rod 106*a*. When the cam goes into motion, the guide rod 106*a* is temporarily disengage from the support of the cam 104. The spring 105 on the other end of the rod is used to pull so that the guide rod 106*a* moves the linkage 11 in a rapid manner into a slanted angle (approximately 30 degrees, as shown in FIG. 5*b*). After the cam 104 is in motion, the discontinuous outer curves of the cam 104 slowly move the guide rod 106*a* (including the linkage) (as shown in Figure Sc) back to the original position (as shown in Figure Sd).

Finally, please refer to FIG. 6, which is the actual implementation of the design of the present invention. The stuffed toy demonstrated in the Figure is a teddy bear. It looks of drowsiness. As shown in the Figure, when the drive mechanism in the interior of the stuffed toy begins to move, accompanied by the music "lullaby," the teddy bear's head 31 quickly lowers and slowing returns to its original position, resembling of sleepiness, or nodding off, thereby increasing animation and entertaining value.

I claim:

1. An animated stuffed toy comprising:

a drive mechanism comprising a box and a upward extending linkage, said box being positioned in an abdominal region of said stuffed toy, said linkage extends upward toward a cranial region of said stuffed toy, said box comprises a driving motor, a control circuit, a gear box and an output shaft to control speed, a spring, a cam, a speaker, and a supporting cross rod which extends downward from said linkage inside said box;

said driving motor is connected to said gear box and by using gears and pinions inside said gear box to adjust and control a rotating speed of said output shaft, which in turn controls a rotating speed of the cam, two sides of said supporting cross rod are situated loosely at two sides of said box so as to move in conjunction with the rotation of said output shaft, at a position below said cross rod near said cam is a guide rod, said spring is connected to said cross rod and said box; whereby movement of said cam moves said guide rod and puts into motion said cross rod and said linkage which extends upward, said cam engaging and disengaging with said guide rod to create a nodding off motion of said stuffed toy, said spring causing said guide rod to also move.

2. The animated stuffed toy as claimed in claim 1, wherein:

said cam comprises three sections of discontinuous curves.

3. The animated stuffed toy as claimed in claim 1, wherein:

a sensor is included on a disc in a position to be activated by a user.

4. The animated stuffed toy as claimed in claim 3, wherein:

said sensor is activated by touch.

5. The animated stuffed toy as claimed in claim 3, wherein:

said sensor is activated by sound.

* * * * *